US009227120B2

(12) United States Patent
McTamaney

(10) Patent No.: US 9,227,120 B2
(45) Date of Patent: Jan. 5, 2016

(54) COVER FOR HANDLE GRIP

(71) Applicant: Matthew J. McTamaney, Scotch Plains, NJ (US)

(72) Inventor: Matthew J. McTamaney, Scotch Plains, NJ (US)

( * ) Notice: Subject to any disclaimer, the term of this patent is extended or adjusted under 35 U.S.C. 154(b) by 92 days.

(21) Appl. No.: 13/732,716

(22) Filed: Jan. 2, 2013

(65) Prior Publication Data

US 2014/0182755 A1 Jul. 3, 2014

(51) Int. Cl.
*A63B 57/00* (2015.01)
*A63B 59/00* (2015.01)

(52) U.S. Cl.
CPC ..... *A63B 59/0029* (2013.01); *A63B 59/0033* (2013.01); *A63B 57/0031* (2013.01); *A63B 57/0075* (2013.01); *A63B 57/0087* (2013.01)

(58) Field of Classification Search
CPC ..... A63B 57/00; A63B 53/14; A63B 59/0029
USPC ..... 473/201.3, 299; 16/436; 150/155, 160, 150/161, 163; 206/315.1, 443; 74/551.9
See application file for complete search history.

(56) References Cited

U.S. PATENT DOCUMENTS

| | | | | |
|---|---|---|---|---|
| 1,617,972 | A | 2/1927 | Wallace | |
| 1,686,323 | A | 10/1928 | VonderHeyde | |
| 1,709,546 | A | 4/1929 | Stanton | |
| 1,819,912 | A | 8/1931 | McGaffey | |
| 1,997,382 | A | 4/1935 | Howell | |
| 2,133,696 | A * | 10/1938 | Hall | 473/299 |
| 2,261,959 | A * | 11/1941 | Buttikofer | 473/285 |
| 2,508,525 | A | 5/1950 | Le Fevre | |
| 2,700,547 | A | 1/1955 | Kraeling | |
| 2,739,331 | A | 3/1956 | Goodman | |
| 3,023,795 | A | 3/1962 | Denkert | |
| 3,147,012 | A | 9/1964 | Sullivan | |
| 3,397,891 | A | 8/1968 | Koch | |
| 3,426,815 | A | 2/1969 | Ashlin et al. | |
| 3,938,570 | A | 2/1976 | Stewart | |
| D266,445 | S | 10/1982 | Yokotaki | |
| D273,968 | S | 5/1984 | Masai et al. | |
| D280,119 | S | 8/1985 | McRae | |
| 4,535,649 | A * | 8/1985 | Stahel | 74/551.9 |

(Continued)

FOREIGN PATENT DOCUMENTS

| | | | |
|---|---|---|---|
| DE | 2634656 B1 * | 2/1978 | |
| FR | 2573315 A1 * | 5/1986 | |

OTHER PUBLICATIONS

"g-glove® High-Visibility Golf Club Grip Protector Promises Clean, Dry Grips : Distincti . . . " dated Aug. 4, 2008 from http://www.prweb.com/releases/wideright/club_grip/prweb1181314.htm.

(Continued)

*Primary Examiner* — Sue A Weaver
(74) *Attorney, Agent, or Firm* — Lerner, David, Littenberg, Krumholz & Mentlik, LLP

(57) ABSTRACT

A cover for a shaft having a grip on one end is provided. The cover may include a cap having a base and a protrusion that extends from the base. The cover may further include a sleeve for covering at least a portion of the grip that extends from the cap. The sleeve may have a first end seated against the cap and a second free end. A cover for insertion into a shaft is also provided. Such a cover may include a cap insertable into an end of the shaft and a sleeve that extends from the cap. The sleeve may have a first end attached to the cap and a second free end. A combination of the shaft and the cover is also provided.

17 Claims, 6 Drawing Sheets

(56) References Cited

U.S. PATENT DOCUMENTS

| | | | | | |
|---|---|---|---|---|---|
| D280,756 | S | | 9/1985 | Kaner | |
| 4,662,415 | A | | 5/1987 | Proutt | |
| D295,544 | S | | 5/1988 | Rice | |
| 4,799,684 | A | * | 1/1989 | Rango | 473/286 |
| 4,938,349 | A | | 7/1990 | Burns | |
| 4,957,293 | A | * | 9/1990 | Byrd | 473/285 |
| D312,289 | S | | 11/1990 | Pace | |
| D318,705 | S | | 7/1991 | Arato | |
| D319,278 | S | | 8/1991 | Tosti | |
| D319,677 | S | | 9/1991 | Rendall, Jr. | |
| 5,088,600 | A | | 2/1992 | Kopp, Jr. | |
| 5,118,107 | A | | 6/1992 | Bucher | |
| D329,483 | S | | 9/1992 | Herold | |
| 5,203,390 | A | | 4/1993 | Eckstein | |
| D336,501 | S | | 6/1993 | Crosby | |
| 5,398,934 | A | * | 3/1995 | Soong | 473/299 |
| D360,447 | S | | 7/1995 | Howe, Jr. et al. | |
| D372,754 | S | | 8/1996 | Rapoza | |
| D374,051 | S | | 9/1996 | Sheppard, Jr. | |
| D375,268 | S | | 11/1996 | Stryczek | |
| 5,573,241 | A | | 11/1996 | Anderson | |
| 5,575,720 | A | | 11/1996 | Daniel | |
| 5,575,721 | A | | 11/1996 | Lilly | |
| D376,258 | S | | 12/1996 | Rupe | |
| 5,626,527 | A | * | 5/1997 | Eberlein | 473/203 |
| 5,720,388 | A | | 2/1998 | King et al. | |
| 5,738,157 | A | | 4/1998 | Gaffney | |
| D395,694 | S | | 6/1998 | Perry et al. | |
| 5,772,524 | A | | 6/1998 | Huang | |
| D396,259 | S | | 7/1998 | Pollard | |
| D397,181 | S | | 8/1998 | Pollard | |
| D397,185 | S | | 8/1998 | Pollard | |
| 5,906,548 | A | * | 5/1999 | Hadge | 473/206 |
| D443,322 | S | | 6/2001 | Henry | |
| D449,665 | S | | 10/2001 | Etherton et al. | |
| 6,385,817 | B1 | | 5/2002 | Johnson | |
| D465,536 | S | | 11/2002 | Pontiff | |
| D465,821 | S | | 11/2002 | Pontiff | |
| D466,172 | S | | 11/2002 | Pontiff | |
| D466,568 | S | | 12/2002 | Pontiff | |
| D466,569 | S | | 12/2002 | Pontiff | |
| D466,570 | S | | 12/2002 | Pontiff | |
| D466,571 | S | | 12/2002 | Pontiff | |
| D470,207 | S | | 2/2003 | Pontiff | |
| D476,479 | S | | 7/2003 | Bailey | |
| 6,669,584 | B1 | * | 12/2003 | Miller | 473/568 |
| D488,202 | S | | 4/2004 | Jaffe | |
| D519,591 | S | | 4/2006 | Marcoux et al. | |
| D520,095 | S | | 5/2006 | Wright | |
| D538,872 | S | | 3/2007 | Machado | |
| D571,911 | S | | 6/2008 | Osterberg | |
| 7,399,236 | B2 | * | 7/2008 | Takeuchi | 473/300 |
| 7,582,023 | B2 | * | 9/2009 | Hung | 473/299 |
| 7,814,950 | B2 | | 10/2010 | Martin | |
| 7,828,680 | B2 | * | 11/2010 | Pfeifer | 473/513 |
| D633,966 | S | | 3/2011 | Savarese et al. | |
| 7,931,544 | B2 | * | 4/2011 | Gill | 473/300 |
| D654,688 | S | | 2/2012 | Lytle et al. | |
| D659,787 | S | | 5/2012 | Balareta et al. | |
| 8,225,830 | B2 | | 7/2012 | Maeng et al. | |
| 2003/0096660 | A1 | * | 5/2003 | Ward et al. | 473/299 |
| 2007/0068612 | A1 | | 3/2007 | Potter | |
| 2008/0085792 | A1 | * | 4/2008 | Sims et al. | 473/564 |
| 2008/0264534 | A1 | | 10/2008 | Carey | |
| 2011/0048595 | A1 | | 3/2011 | Griffith | |
| 2011/0124431 | A1 | * | 5/2011 | Karube | 473/300 |
| 2011/0143853 | A1 | * | 6/2011 | Walls | 473/300 |
| 2011/0300965 | A1 | * | 12/2011 | Gill | 473/299 |
| 2012/0090746 | A1 | | 4/2012 | Barnett | |

OTHER PUBLICATIONS

"Where can I find plastic golf grip covers?—The "WRX" Clubmaking Shop—GolfWRX," dated Jul. 19, 2011 from http://www.golfwrx.com/forums/topic/496458-where-can-i-find-plastic-golf-grip-covers/.

"The Golf Condom Golfblogger Golf News, Reviews and Commentary," dated Nov. 25, 2011 from http://www.golfblogger.com/index.php/golf/comments/the_golf_condom/.

"Where can I find a Trojan Condom golf club cover?—Yahoo! Answers," dated Jul. 7, 2008 from http://answers.yahoo.com/question/index?gid=20080701122103AAmeW3u.

* cited by examiner

COVER FOR HANDLE GRIP

BACKGROUND OF THE INVENTION

The present invention relates to systems and methods for covering grips of shafts, handles and the like, and in particular to extendable and retractable covers for grips used on such shafts, handles and the like that may be exposed to moisture.

Golfers around the world, particularly those in wetter climates such as those found in the United Kingdom or the northwestern part of the United States, often play the already challenging sport of golf in the rain, sometimes from the start to the finish of a round. Players of other sports, such as tennis, hockey, and lacrosse, also often deal with inclement weather or with other sources of moisture that cause the grip on the shaft of their respective main pieces of equipment, i.e., tennis rackets, hockey sticks, and lacrosse sticks, to become slippery.

Golf clubs have a shaft at a proximal end thereof that is grasped by a golfer and a clubhead at a distal end thereof that is used to strike a golf ball. It used to be common for grips to be composed of leather strips wrapped around a proximal end of a shaft nearest the golfer. More common today is the use of grips made of natural or synthetic rubber, or other synthetic or composite materials that are often secured to the shaft by an adhesive, for example. Moreover, grips today have varying degrees of softness or firmness depending on the preferences of the golfer. The choice of grip however can have an impact on a golfer's performance. Softer grips often have poorer performance when wetted, which generally occurs during a rain storm or as a golfer's hands become sweaty during a round, for example. A golfer's clubs can be exposed to wet or moist conditions during use, even when in a golfer's bag during a round as various clubs are interchanged, as well as when placed in storage.

A few designs for covering golf club grips have been devised over the past few decades to help keep the grips dry. However, there exists a need for a cover that is adaptable to the grips of golf clubs or shafts on other sports equipment generally used by respective players of those sports today, that maintains engagement with such grips even while the golf club or other equipment is in use, and that allows the user to quickly cover and uncover the grips during use thereof.

BRIEF SUMMARY OF THE INVENTION

In one aspect of the invention, a cover for a shaft having a grip on one end may include a cap and a sleeve. The cap may include a base and a protrusion that extends from the base. The sleeve may be extendable from the cap for covering at least a portion of the grip of the shaft. The sleeve may have a first end seated against the cap and a second free end.

In another aspect of the invention, a shaft and cover combination may include a shaft having a grip on one end. The combination may further include a cap attached to the one end of the shaft and a sleeve extendable from the cap and over the grip. The sleeve may have a first end attached to the cap and a second free end.

In another aspect of the invention, a cover for insertion into a shaft having a grip on one end may include a cap and a sleeve. The cap may be insertable into the one end of the shaft. The sleeve may extend from the cap. The sleeve may have a first end attached to the cap and a second free end.

DETAILED DESCRIPTION

Figure 1:
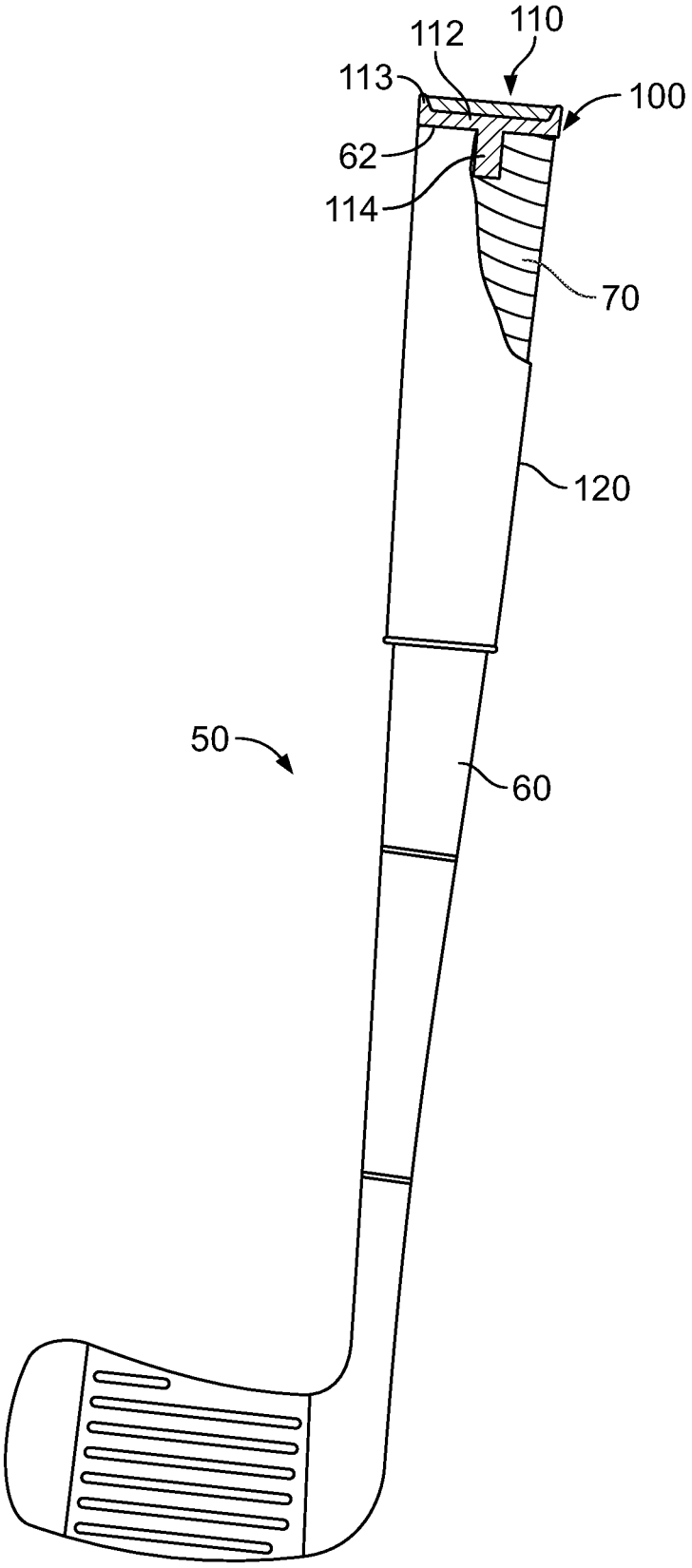
FIG. 1 is a perspective view of a golf club having a cover for a grip thereof in accordance with an embodiment of the present invention.
Figure 2A:
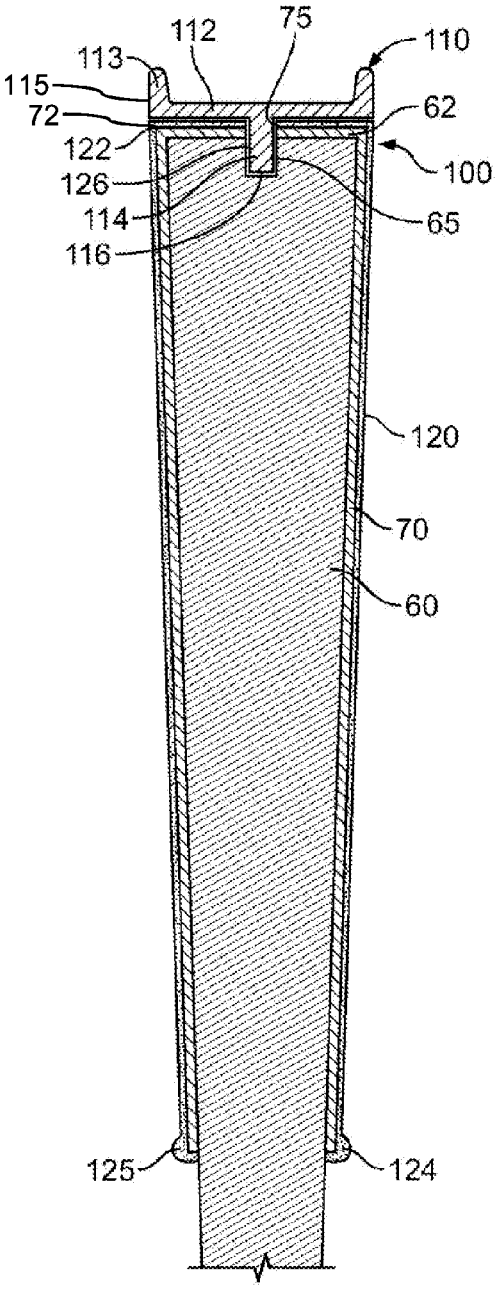
FIGS. 2A and 2B are cross-sectional side views of a top portion of the golf club of FIG. 1 taken along line 2-2 in which the cover is extended to cover the grip, as shown in FIG. 2A and in which the cover is retracted, as shown in FIG. 2B.
Figure 2B:
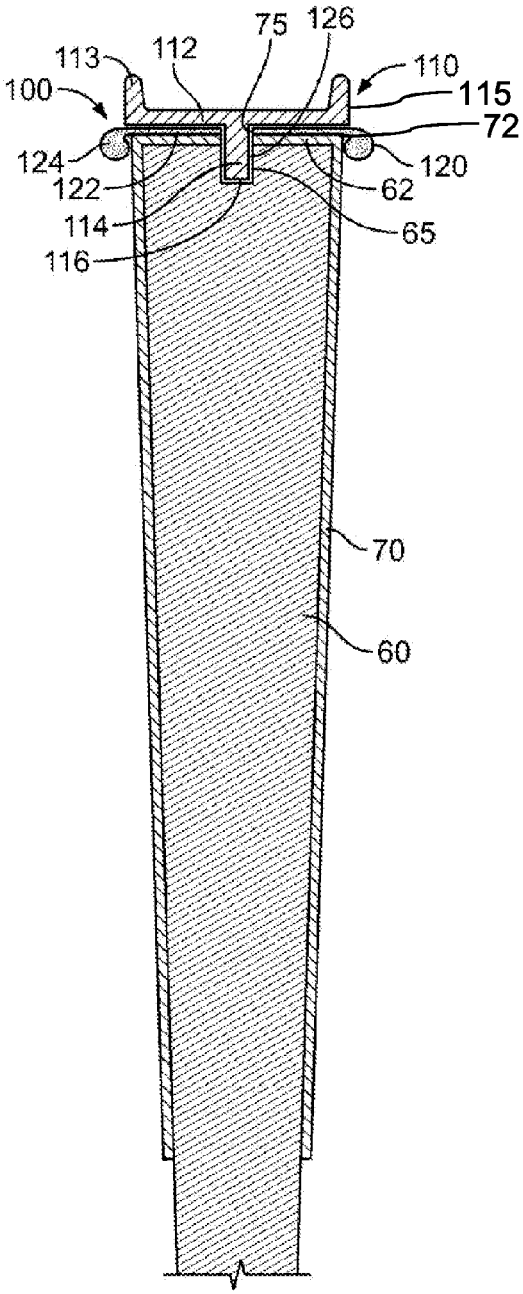

Referring to FIGS. 1, 2A, and 2B of the drawings, a club 50 used for golfing may include a shaft 60 covered on a proximal end by a grip 70 that may be used as a handle. A cover 100 may include a cap 110 inserted into a butt end 62 of the club 50 and a sleeve 120 that may be placed around an outer edge 72 of at least a portion of the grip 70 to cover the grip 70 which is often made of rubber or other flexible polymeric porous materials.

As best shown in FIGS. 2A and 2B, the shaft 60 may have a cavity 65 extending through the butt end 62. When the cover 100 is assembled with the shaft 60, a protrusion 114 of the cap 110 may extend from a base 112 through a hole 126 passing through a first end 122 of the sleeve 120, through an aperture 75 of the grip 70, and into the cavity 65 of the shaft 60. In some arrangements, as shown in FIGS. 2A and 2B, the protrusion 114 may have a threaded outside diameter that may engage a threaded internal diameter of the cavity 65. In other arrangements, an outer diameter of the protrusion 114 may be substantially the same as an inner diameter of the cavity 65 such that an interference fit is created between the protrusion 114 and the cavity 65 upon insertion of the cap 110 into the shaft 60. In such arrangements, the protrusion 114 may be a peg or pin. When using a screw or press-fit connection or other similar fastening methods, the interconnection of the cap and the shaft need only be strong enough to maintain the interconnection during use such that, in general, the cap is easily removeable and replaceable without causing damage to the shaft.

As further shown, in some arrangements, a tip 116 at a distal end of the protrusion 114 may be flat. Moreover, although the protrusion 114 is shown as extending along a longitudinal axis of the shaft 60 in FIGS. 2A and 2B, a protrusion 114 may be configured to extend into the shaft 60 in directions oblique to the longitudinal axis of the shaft 60 (not shown) so long as the protrusion affixes the cap to the shaft. As further shown in the arrangement to FIGS. 2A and 2B, a rim 113 may protrude from outer circumference 115 of the base 112 in a direction away from the grip 70. Such a rim may be used to hold various objects such as, but not limited to, ball markers, golf tees, brushes depending on the height of the rim.

As the portion of the cover that covers the most surface area of the grip including the portion grasped by a user, the sleeve serves the function of preventing or at least inhibiting the intrusion of unwanted elements such as moisture or debris into the grip. As such, the sleeve may be at least dust-tight, but is more preferably splash proof or water resistant, and is even more preferably water-proof up to a predetermined depth of submersion in water. Sleeve may be made of various moisture-resistant materials including, but not limited to, latex rubber, lambskin, polyurethane, polyisoprene, lycra, nylon, or any other suitable material. The sleeve is preferably made of flexible and compressible materials such as latex which can have a very thin construction and may be easily manipulable.

In serving the function of a barrier, the sleeve 120 may be tightly wrapped around the protrusion 114 when the cap 110 is inserted into the shaft 60, the first end 122 of the sleeve 120 may be compressed between the base 112 of the cap 110 and the grip 70 of the club 50. The base 112 may have at least a distal surface having a profile and a contour, such as a flat or concave surface, that matches the profile and contour of the butt end 62 of the club 50 which may have a corresponding contour. As shown, the outer circumference 115 of the base 112 may extend to at least the outer edge 72 of the grip 70. In this manner, the base 112 may apply pressure over its entire surface against the nearest proximal end of the club 50 for compressing the sleeve 120 between the base 112 and the nearest proximal end of the club 50 to aid in preventing water intrusion into the cover 100. The sleeve 120 may be in an extended state, as shown in FIG. 2A, in which a second end 124 of the sleeve 120 may overlap a predetermined portion of the grip 70, and preferably, the entire grip 70, as shown in FIG. 2A. In this configuration, a lip 125 may be formed adjacent to a distal end of the grip 70 in which the lip 125 has a thickness to provide a sufficient surface for pushing or rolling the second end 124 of the sleeve 120 towards a proximal end of the grip 70. In a retracted state shown in FIG. 2B, the sleeve 120 may be rolled up or compressed such that both the first and second ends 122, 124 of the sleeve 120 are both located at the proximal end of the grip 70.

Figure 3A:
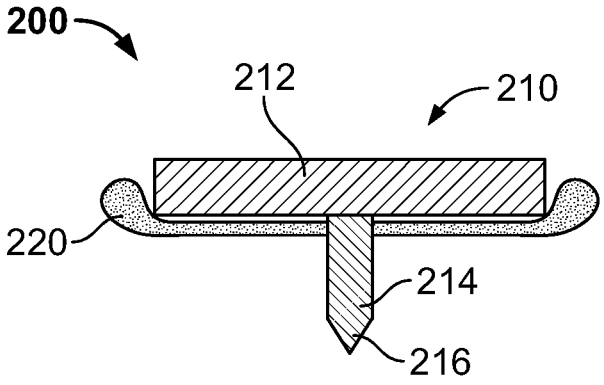
FIGS. 3A and 3B are cross-sectional side views of covers for grips in a retracted position in accordance with other embodiments of the present invention.
Figure 3B:
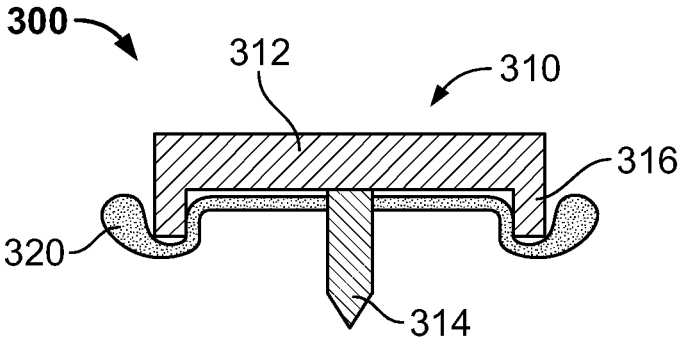

FIGS. 3A and 3B illustrate alternative configurations of the cover 100 that may be used in combination with the club 50. As shown in these figures, covers 200 and 300 may have essentially the same features as the cover 100 with certain notable exceptions. In particular, in some arrangements, the cover 200 may include a base 212 having flat or substantially flat upper and lower surfaces. As further shown in this arrangement, a protrusion 214 of the cover 200 may have a tapered tip 216. The protrusion 214 may be inserted into a hole of a sleeve 220 that is substantially the same as the sleeve 120. In other arrangements, the cover 300 may include a ridge 316 extending in a direction toward a sleeve 320 into which a protrusion 314 is inserted and positioned around the circumference of a base 312. The ridge 316 may have an inner diameter that is just larger than the outer diameter of the butt end 62 of the club 50 such that the ridge 316 may be placed around the outer diameter of the butt end 62. In this manner, the sleeve may be compressed between the ridge 316 of the cap 310 and the grip 70 of the club 50 when the cover 300 is inserted into the club 50. Such a configuration provides a measure to prevent debris or moisture from being entrapped between the sleeve 320 and the base 312 of the cover 300.

Figure 4A:
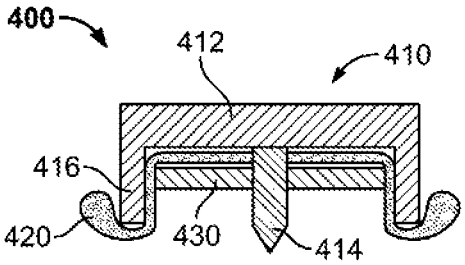
FIGS. 4A-4D are cross-sectional side views of covers for grips in a retracted position including inserts in accordance with other embodiments of the present invention.

In another embodiment as shown in the examples of FIGS. 4A-4D, an insert may be used as an additional component of a cover. In the example of FIG. 4A, a cover 400 includes a cap 410 having a base 412 from which a protrusion 414 may extend in a direction perpendicular to the base 412. A ridge 416 may also extend from the base 412 in the direction towards the protrusion 414 and may circumscribe the edge of the distal surface of the base 412. The protrusion 414 of the cap 410 may be inserted through a hole of a sleeve 420 and through a hole of an insert 430 positioned within a space defined by the ridge 416 and the base 412.

As shown, the ridge 416 may be larger than the ridge 316 shown in the embodiment of FIG. 3B such that the ridge 416 extends completely over the insert 430. As further shown, in some arrangements, the outer diameter of the protrusion 414 and the inner diameter of the hole through the insert 430 may have corresponding threads to form a threaded connection when the protrusion 414 is inserted through the hole of the insert 430. In other arrangements (not shown), the outer diameter of the protrusion may be an unthreaded pin or peg that is slightly larger than the inner diameter of the hole of the insert 430 such that the outer diameter of the protrusion and the inner diameter of the hole of the insert may form an interference fit to maintain their interconnection. Moreover, the insert 430 may further have an outer perimeter that is closely matched to an inner perimeter of the cap 410 defined by the ridge 416. Through the use of the insert 430, the sleeve 420 may be compressed between the base 412 and the insert 430 to provide additional support for maintaining the interconnection between the cap 410 and the sleeve 420, as shown in FIG. 4A. Similarly to the ridge 316 in the example of FIG. 3B, the ridge 416 may have an inner diameter that is just larger than the outer diameter of the butt end 62 of the club 50 such that the ridge 416 may be placed around the outer diameter of the proximal end of a club such as the club 50. As such, the insert 430 may have a cylindrical profile such that the perimeter of the insert 430 defines a diameter of the insert 430.

Figure 4B:
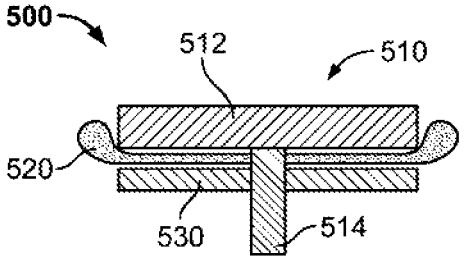
Figure 4C:
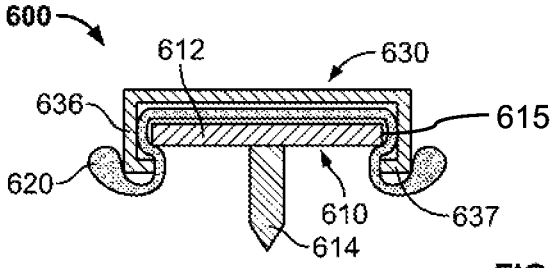

Referring to FIG. 4B, a cap 510 of a cover 500 having substantially the same features as the cap 210 described previously herein may be coupled to an insert 530 to compress a sleeve 520. In the example of FIG. 4C, a cover 600 may include a cap 610 having substantially the same features as the cap 210 that may be inserted into an overlay 630. The overlay 630 may include an overlay base 635 and a ridge 636 extending from a perimeter of the base 635. The ridge 636 may have an inner diameter that is larger than the outer diameter of the butt end 62 of the club 50 such that the ridge 636 may be placed around the outer diameter of the butt end 62. Like cap 110 and 210, an outer circumference 615 of the base 612 of the cap 610 may extend to the outer edge 72 of the grip 70 when installed on the club 50. The overlay 630 may further have a tab 637 extending from a distal portion of a perimeter of the ridge 636 such that the tab 637 overlaps a distal surface of a base 612 of the cap 610. In this manner, the cap 610 may be inserted into the overlay 630. As further shown in FIG. 4C, a sleeve 620 may be compressed between the overlay 630 and the cap 610. Such an arrangement eliminates any need for a hole through the sleeve 620 as a protrusion 614 of the cap 610 used for insertion into a club, in a manner similar to other caps described previously herein, lies entirely distal to the sleeve 620 when the cover 600 is inserted into a club. Furthermore, the tab 637 allows for an interconnection between the cap 610 and the overlay 630 without requiring the use of any holes in either of these elements. Being flexible, the sleeve 620 may be wrapped over the perimeter of the base 612 of the cap 610 as well as over the tab 637 of the overlay 630 and the sleeve 620 may further have a length such that it may be extended down to cover all or at least a portion of a grip of a club.

Figure 4D:
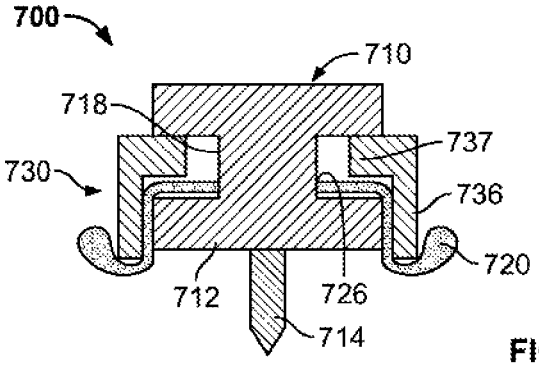

As shown in the example of FIG. 4D, a cover 700 may include a cap 710 having a base 712 with a groove 718 formed around a perimeter thereof and a protrusion 714 extending therefrom. As shown, the base 712 may have a circular profile which may often match the profile of the distal end of a club into which the cover 700 is inserted in a manner similar to other covers described previously herein. A sleeve 720 may include a hole such that the sleeve 720 may be tightly wrapped around the groove 718 of the cap 710 and may further have a length such that the sleeve 720 may cover a grip of a club as described previously herein. As shown, the cover 700 may include an insert 730 having a tab 737 that fits into the groove 718 and to compress and hold the sleeve 720 against the base 712 upon assembly of the cover 700. The insert 730 may further have a ridge 736 extending from a perimeter of the tab 737 and over a distal portion of the base 712 adjacent the protrusion 714 that may also act to compress and hold the sleeve 720 against the base 712.

Figure 5A:
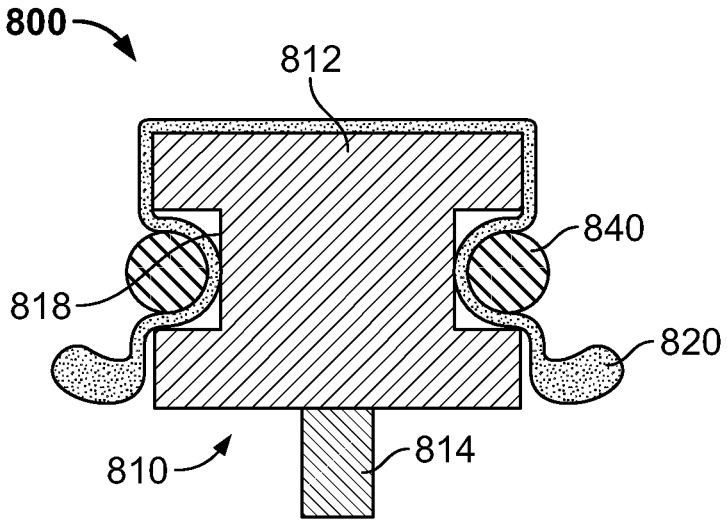
FIGS. 5A and 5B are cross-sectional side views of a cover for a grip in a retracted position including a resilient holder in accordance with an embodiment of the present invention.
Figure 5B:
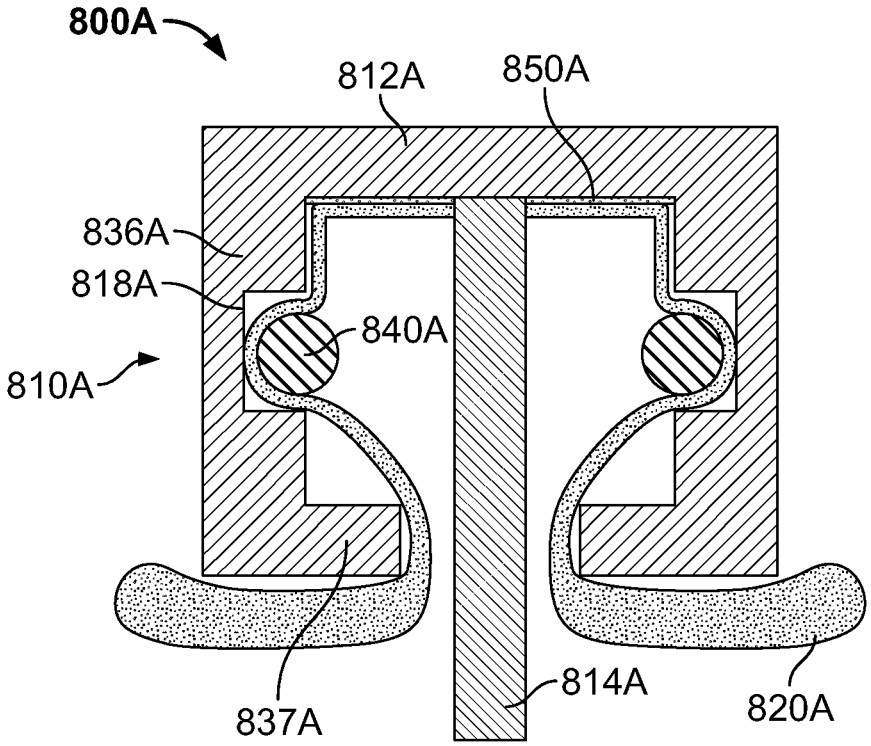

Referring now to FIG. 5A, a cover 800 may include a cap 810 having substantially the same features as the cap 710 in which the cap 810 may include a protrusion 814 for insertion into a club in manner such as the clubs described previously herein. In contrast to the cover 700, the cover 800 may include a sleeve 820 that is draped over a base 812 and that may further have an extendable length such that the sleeve 820 may cover a grip of a club as described previously herein. As shown, the base 812 may include a groove 818 formed on an external surface thereof. In a reverse arrangement as shown in FIG. 5B, a cap 810A of a cover 800A having substantially the same features as the cap 610 may have a groove 818A formed within a ridge 836A extending from a base 812A of the cap 810A in which a protrusion 814A extends distally from the base 812A. In the arrangement of FIG. 5B, a tab 837A extends from the ridge 836A as described previously with respect to the tab 637 of the cover 600.

In each of the configurations of FIGS. 5A and 5B, a resilient member, such as a seal 840, 840A, may be placed over a portion of the sleeve 820, 820A and into the groove 818, 818A such that the seal 840, 840A compresses and holds the sleeve 820, 820A against the base 812, 812A to maintain an interconnection between the sleeve 820, 820A and the cap 810, 810A. As shown, the seal 840, 840A may be a rubber o-ring. As shown in FIG. 5B, in some arrangements, a proximal portion of the sleeve 820A may be held against a distal side of the base 812A by an adhesive 850A, such as epoxy. In some arrangements, an insert (not shown) may be inserted around the protrusion 814A or the club 50 may be inserted into the cover 800 to compress the sleeve 820A against the distal side of the base 812A, although other known mechanisms may also be used to hold the sleeve 820A against the base 812A.

Figure 6:
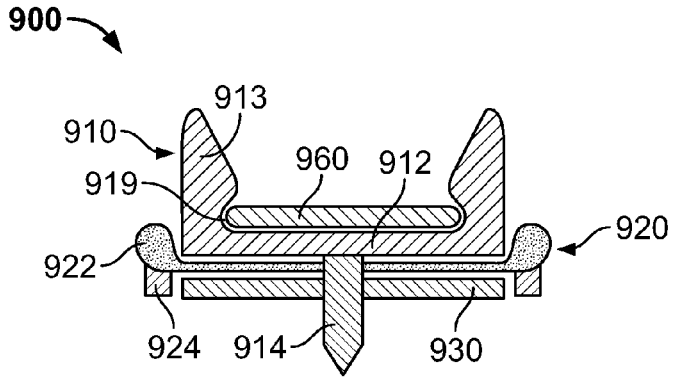
FIG. 6 is a perspective view of a cover for a grip in a retracted position incorporating a ball marker in accordance with an embodiment of the present invention.

Various elements may be added to any of the embodiments of covers exemplified previously herein. As shown in the example of FIG. 6, a cover 900 may include a cap 910 having a cylindrical base 912 and a cylindrical protrusion 914 extending in a distal direction therefrom with respect to a club into which the cover 900 may be inserted. The base 912 may include a rim 913 extending from a circumference of the base 912 in a proximal direction. The rim 913 may have a rim groove 919 around an inner perimeter or inner circumference of the rim 913 into which a marker 960, such as a ball marker for use in playing golf, may be placed as shown. The protrusion 914 of the cap 910 may be inserted through a hole of a sleeve 920 as well as a hole of an insert 630 in a manner similar to the interconnection of the cap 510 into both the sleeve 520 and the insert 530. The sleeve 920 may include a sleeve end 924 which may be bonded to a sleeve sheath 922 through any well-known methods of bonding such as through, but not limited to, a melting process or the use of an adhesive. The features shown in and described with respect to FIG. 6 and not included in the embodiments may be added to any of the other embodiments described herein, where possible.

Figure 7:
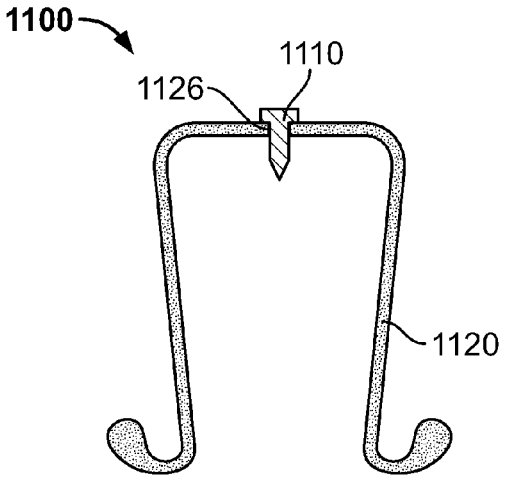
FIG. 7 is a cross-sectional side view of a cover for a grip in a retracted position in accordance with an embodiment of the present invention.

In another embodiment as shown in the example of FIG. 7, a cover 1100 may include a sleeve 1120 having a hole 1126 into which a fastener 1110 may be inserted. The fastener 1110 may be a standard fastener such as a screw or nail having a head and a shank such that the fastener may be inserted into a butt end of a club as described with respect to the covers described previously herein. When the fastener 1110 is inserted into a club, the head of the fastener may compress a portion of the sleeve around the hole 1126 of the sleeve 1120 to maintain the sleeve in place. Similar to other sleeves described previously herein, the sleeve 1120 may have a length such that the sleeve 1120 may be extended to cover at least a portion of a grip of a club for use in preventing wetting of the grip. In a variation of such an arrangement, the fastener may have a construction such as that of a golf tee in which the golf tee may be pressed into a proximal end of a club having a preformed cavity for receiving the tee.

Figure 8:
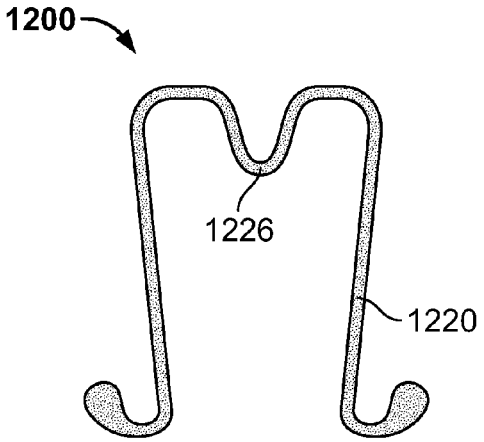
FIG. 8 is a cross-sectional side view of a cover for a grip in a retracted position in accordance with an embodiment of the present invention.

In a further embodiment exemplified by the example of FIG. 8, a cover 1200 may include a sleeve 1220 having a length for covering at least a portion of a grip of a club as described previously herein and a central indent 1226 that may be pressed into a cavity on the proximal end of a club, such as the cavity described in detail previously herein with respect to FIGS. 1, 2A, and 2B. The central indent 1226 may be molded into such a form. In some arrangements, the central indent 1226 may be thicker than the rest of the cover 1200. A wedge may be used to press the central indent 1226 into the distal end of the club. Such a configuration provides a simple construction and does not require any perforation of the sleeve 1220 that may otherwise create a path for water intrusion.

In an alternative arrangement of any of the above-described embodiments, the sleeve of a cover may include a zipper (not shown) such that when the zipper is unzipped to a first position, the sleeve is slidable along a shaft of a club onto which the cover is placed, and when the zipper is zipped to a second position, the sleeve is not slidable along the shaft. In another alternative arrangement, the sleeve may include corresponding parts of a snap (not shown) that snap together such that when the parts of the snap are not snapped together, the sleeve is slidable along the shaft, and when the parts of the snap are snapped together, the sleeve is not slidable along the shaft.

Although the embodiments shown and described previously herein have been discussed with respect to a club, and in particular with respect to FIGS. 1, 2A, and 2B, with respect to a golf club, it is to be understood that the covers of the various embodiments described previously herein are intended for use with other objects in which a good grip is preferred such as, but not limited to, a hockey stick, a tennis racket, a badminton racket, a cricket stick, a field hockey stick, a baseball bat, a lacrosse stick, and a police baton.

It is to be further understood that features shown and discussed with respect to one aspect, embodiment, arrangement or configuration of the invention may be used in conjunction with any other aspect, embodiment, arrangement or configuration of the invention. For example, although certain figures and their corresponding descriptions illustrate protrusions including, but not limited to, one or more of a flat tip, a tapered tip, a threaded tip, and an unthreaded tip, it is to be understood that any of the features of the other of the protrusions may also be used in accordance with any embodiment shown or described.

Furthermore, although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A cover for a shaft having a grip on an end thereof, the cover comprising:

a cap including a base and a protrusion extending therefrom, the cap having an outer circumference;

a sleeve extendable from the cap for covering at least a portion of the grip, the sleeve having a first end seated against the cap and a second free end; and an overlay, wherein the sleeve is held between the cap and the overlay, wherein the sleeve and the cap extend to an outer edge of the grip, and wherein the overlay extends to the outer circumference of the cap.

2. The cover of claim 1, wherein the sleeve is extendable such that the second end is movable between a first position adjacent to the cap to a second position a predetermined distance away from the cap.

3. The cover of claim 1, wherein the overlay comprises an overlay base and a ridge extending from a perimeter of the overlay base, wherein at least a portion of the ridge overlies an edge of the base of the cap, and wherein when the sleeve is extended, the sleeve extends between the ridge of the overlay and the cap.

4. The cover of claim 3, wherein the overlay further comprises a tab extending from the ridge, the tab overlapping a surface of the base of the cap opposite a surface of the base of the cap against which the first end of the sleeve is seated.

5. A shaft and cover combination comprising:

a shaft having a grip on an end thereof, the grip having an outer edge;

a cap attached to the end of the shaft and having an outer circumference;

a sleeve extendable from the cap and over the grip, the sleeve having a first end seated against the cap and a second free end; and an overlay, wherein the sleeve is held between the cap and the overlay, wherein the sleeve and the cap extend to the outer edge of the grip, and wherein the overlay extends to the outer circumference of the cap.

6. The covered shaft of claim 5, wherein the sleeve is extendable such that the second end is movable between a first position not covering a portion of the shaft to a second position covering at least a portion of the grip not covered by the sleeve in the first position.

7. The covered shaft of claim 5, the shaft being a shaft of a golf club, wherein the cap includes a base and a protrusion extending therefrom, and wherein the protrusion couples the cap to the shaft.

8. The covered shaft of claim 7, wherein a proximal end of the shaft has a hole sized for fixation of the protrusion therein through one of a threaded connection or interference fit.

9. The covered shaft of claim 7, wherein the sleeve is made of a resilient material and has a shape that substantially conforms to the shape of the grip.

10. The covered shaft of claim 9, wherein the sleeve extends entirely over the grip such that sleeve forms an at least a water-resistant seal around the hand grip.

11. The covered shaft of claim 5, wherein the shaft is one of a golf club, a hockey stick, a tennis racket, a badminton racket, a cricket stick, a field hockey stick, a baseball bat, a lacrosse stick, and a police baton.

12. The cover of claim 5, wherein the overlay comprises an overlay base and a ridge extending from a perimeter of the overlay base, wherein at least a portion of the ridge overlies an edge of the cap, and wherein when the sleeve is extended, the sleeve extends between the ridge and the cap.

13. The cover of claim 12, wherein the overlay further comprises a tab extending from the ridge, the tab overlapping a surface of the cap opposite a surface of the cap against which the first end of the sleeve is seated.

14. A cover for insertion into a shaft, the shaft having a grip on an end thereof, the cover comprising:

a cap insertable into an end of the shaft and having an outer circumference;

a sleeve extending from the cap, the sleeve having a first end seated against the cap and a second free end; and an overlay, wherein the sleeve is held between the cap and the overlay, wherein the sleeve and the cap extend to an outer edge of the grip, and wherein the overlay extends to the outer circumference of the cap.

15. The cover of claim 14, wherein at least one of a ball marker, a brush, and a tee is engaged with the overlay.

16. The cover of claim 14, wherein the overlay comprises an overlay base and a ridge extending from a perimeter of the overlay base, wherein at least a portion of the ridge overlies an edge of the cap, and wherein the sleeve extends between the ridge and the cap.

17. The cover of claim 16, wherein the overlay further comprises a tab extending from the ridge, the tab overlapping a surface of the cap opposite a surface of the cap against which the first end of the sleeve is seated.

* * * * *